US009388631B2

(12) United States Patent
Woeltjen, Jr.

(10) Patent No.: US 9,388,631 B2
(45) Date of Patent: Jul. 12, 2016

(54) PET DOOR

(71) Applicant: Henry J. Woeltjen, Jr., Pembroke Pines, FL (US)

(72) Inventor: Henry J. Woeltjen, Jr., Pembroke Pines, FL (US)

( * ) Notice: Subject to any disclaimer, the term of this patent is extended or adjusted under 35 U.S.C. 154(b) by 0 days.

(21) Appl. No.: 13/921,700

(22) Filed: Jun. 19, 2013

(65) Prior Publication Data

US 2014/0373449 A1 Dec. 25, 2014

(51) Int. Cl.
*E06B 7/32* (2006.01)
*E06B 3/50* (2006.01)
*E06B 5/11* (2006.01)

(52) U.S. Cl.
CPC ..... *E06B 7/32* (2013.01); *E06B 3/5009* (2013.01); *E06B 5/11* (2013.01)

(58) Field of Classification Search
CPC ..... E06B 3/5009; E06B 7/32; E06B 5/11
USPC ..... 49/163–170, 70, 55–57; 160/116, 180, 160/102, 99, 97
See application file for complete search history.

(56) References Cited

U.S. PATENT DOCUMENTS 2,311,413 A 2/1943 Persson
4,103,458 A * 8/1978 Booker ..... 49/56
5,105,868 A * 4/1992 Riise ..... E06B 7/32 160/179
5,185,954 A * 2/1993 Waddle, Sr. ..... 49/168
5,946,855 A * 9/1999 Miconi ..... 49/163
6,164,013 A * 12/2000 Ramsey ..... 49/70
6,550,828 B2 4/2003 Warden
6,962,188 B2 * 11/2005 Coenraets ..... 160/180
7,165,595 B2 * 1/2007 Yamamoto ..... 160/97
7,207,141 B2 * 4/2007 Sullivan ..... 49/169
8,176,962 B2 * 5/2012 Kilfoyle ..... 160/97
2005/0173078 A1 8/2005 Perez, Jr.
2007/0246172 A1 * 10/2007 Okoturo ..... E06B 7/32 160/239
2009/0084326 A1 * 4/2009 Watzke ..... A01K 1/0005 119/843
2009/0246498 A1 * 10/2009 Deiss ..... 428/220
2010/0077669 A1 * 4/2010 Daniel ..... 49/475.1
2010/0192468 A1 * 8/2010 Chubb et al. ..... 49/407
2011/0283621 A1 * 11/2011 Glover ..... 49/130
2013/0047517 A1 * 2/2013 Peterson ..... E06B 7/32 49/463

* cited by examiner

*Primary Examiner* — Gregory J Strimbu
*Assistant Examiner* — Marcus Menezes

(57) ABSTRACT

A pet door connects to the door and to the door frame in both a closed and open position with an opening therein to allow the pet to leave and enter the residence at any time. The pet door also prevents the air-conditioned air from leaving the residence and insects and pests from entering while the door is in the open position.

17 Claims, 6 Drawing Sheets

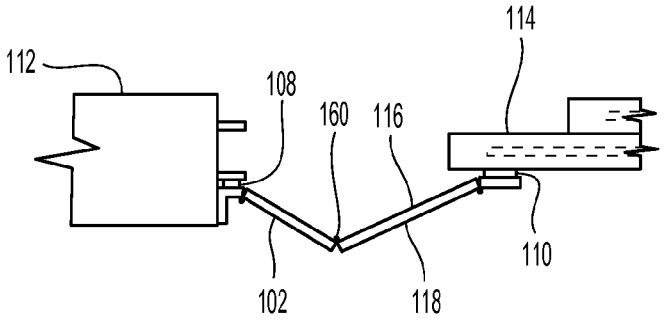
Fig. 2
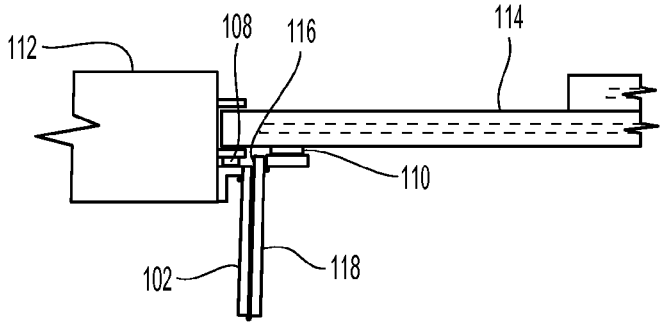
Fig. 3
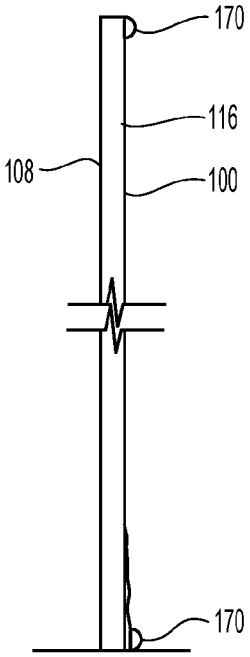

PET DOOR

BACKGROUND OF THE INVENTION

Field of the Invention

Domestic animals, particularly in the warmer climates, like to have access to both the interior of their owners' residences as well as to the outside. While it might be possible to leave a door open for the animals to move freely between the interior and exterior of the house, it is impractical and inefficient to do so in those warmer climates. Leaving a door open to allow for the freedom allows the air-conditioned air to leave and insects, other pests, and hot, humid air to enter. Yet, the owners of the domestic animals may not be willing or available to open and close the door at the pet's whim.

Thus, there is a need to have a door that can allow the pet to leave whenever the pet so desires without the owner having to be physically present to open and close the door.

SUMMARY OF THE INVENTION

The present invention is directed to pet door to be used with a sliding glass door that includes a first panel, the first panel being flexible, and having a first edge portion and a second edge portion, the first edge portion opposite from the second edge portion, an attachment member attached to each of the first first edge portion and the second edge portion, the attachment members connectable to one of a sliding glass door and a door frame associated with the sliding glass door, an opening in a bottom portion of the first panel, the opening sized to allow a pet to pass therethrough, and the first panel being attached to the sliding glass door and the door frame in both a first and a second position, the first position the sliding door being open and the second position the sliding door being closed.

In some embodiments, the first panel has a central portion, the central portion being comprised of a clear material to allow a user to see through the first panel.

In some embodiments, the first panel comprises at least two panels, an upper panel and a lower panel, the upper panel having a see-through portion and the lower panel having the opening for the pet.

In yet other embodiments, the the opening includes at least two intersecting slits, the intersecting slits forming at least two corners in the first panel, the first panel having magnetic elements disposed therein to attract the at least two corners to one another.

In yet other embodiments, the pet door also includes hooking members and a pet container, the hooking members attached to the first panel and extending outwardly from the pet door and into a dwelling to which the sliding glass door is connected to engage the pet container and maintain the pet container in a fixed relation to the pet door.

In yet another aspect, the invention is directed to a pet door to be used with a sliding glass door that includes a first panel, the first panel being flexible, and having a first edge portion and a second edge portion, the first edge portion opposite from the second edge portion, an attachment member attached to each of the first first edge portion and the second edge portion, the attachment members connectable to one of a sliding glass door and a door frame associated with the sliding glass door, an opening in a bottom portion of the first panel, the opening sized to allow a pet to pass therethrough, and an extension disposed on each of a top edge and a bottom edge of the first panel to engage a portion of a frame of the sliding glass door when in the first position, the first panel being attached to the sliding glass door and the door frame in both a first and a second position, the first position the sliding door being open and the second position the sliding door being closed.

In yet another aspect, the invention is directed to a pet door to be used with a sliding glass door that includes a first panel, the first panel being flexible, and having a first edge portion and a second edge portion, the first edge portion opposite from the second edge portion, an attachment member attached to each of the first first edge portion and the second edge portion, the attachment members connectable to one of a sliding glass door and a door frame associated with the sliding glass door, and the attachment member attached to the first edge portion includes a rotatable portion to wind up the first panel during the closing of sliding glass door, an opening in a bottom portion of the first panel, the opening sized to allow a pet to pass therethrough, and the first panel being attached to the sliding glass door and the door frame in both a first and a second position, the first position the sliding door being open and the second position the sliding door being closed.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention and, together with the description, serve to explain the principles and operations of the invention.

BRIEF DESCRIPTION OF THE DRAWINGS

FIG. 2 is a top view of the pet door of FIG. 1 with the door in a partially open position;

FIG. 3 is a top view of the pet door of FIG. 1 with the door is the closed position;

FIG. 4 is a side view of the pet door illustrating the extension on the panel;

DETAILED DESCRIPTION OF THE PREFERRED EMBODIMENTS

Figure 1:
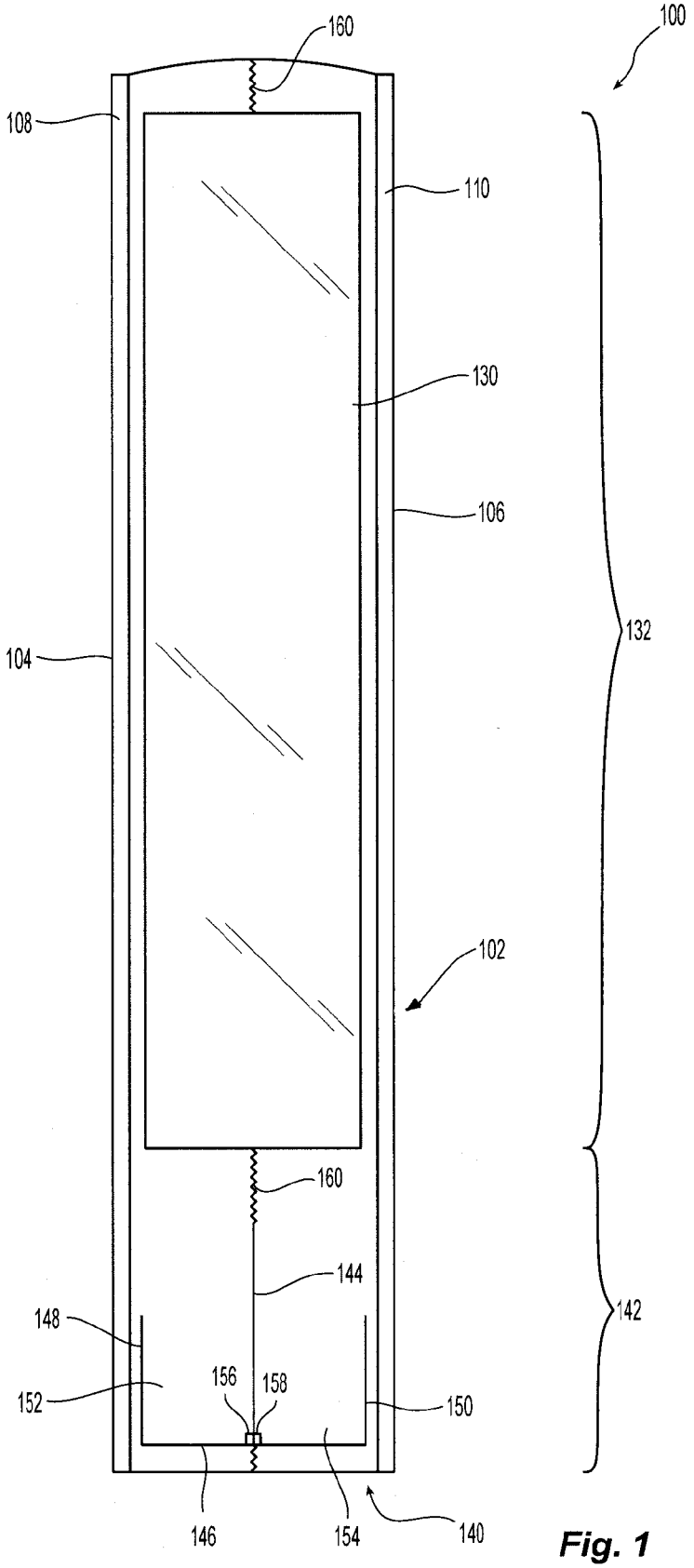
FIG. 1 is a front view of one embodiment of a pet door in an open position according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Referring to FIGS. 1-4, a pet door 100 is illustrated. The pet door 100 has a first panel 102, the first panel having a first edge portion 104 and a second edge portion 106, the first edge portion 104 being on an opposite side of the first panel 102 from the second edge portion 106. By opposite sides, the inventor means in a left versus right edges and not in a front versus back sides. Each of the edge portions 104,106 have an attachment member 108,110, respectively, attached thereto. Each of the attachment members 108,110 are preferably one portion of a hook-and-loop fastener. For example, the attachment members 108,110 could each be the hook portion of the hook-and-loop fastener, the loop portion of the hook-and-loop fastener, or even one could be the hook portion while the other is the loop portion. The corresponding portion of the hook-and-loop fastener is then attached to a door frame 112 and a door 114. See, e.g., FIGS. 2 and 3. The attachment members 108,110 are preferably attached to the same side (for clarity purposes, this means the inside facing side 116 and outside facing side 118 of the panel rather than opposite edges 108,110) of the first panel 102, but could be attached to opposite sides 116,118 as well. Alternatively, the attachment members 108,100 could also be snap fasteners as well. Again, the male and female portions of the snap fasteners could be attached to the pet door 100 and the door/door frame 112/114 in the same manner as described above for the hook-and-loop fasteners. Other types of fasteners (e.g., zippers, buttons, magnets, etc.) could also be used and still fall within the scope of the present invention.

The pet door 100 is preferably made from a pliable material such as PVC, plastic, or other materials suitable for the intended purpose. The pet door 100 may also have rigid portions as described in more detail below. The pet door 100 may have a clear portion 130 in a central portion 132 of the first panel 102 to allow the owner to see through the pet door 100. The clear portion 130 may be transparent plastic (hard or soft/flexible) or, given the appropriate dimensions to allow for movement of the pet door 100 when the door 114 is moved, glass or glass based materials. The clear portion 130 may also be larger or smaller relative to the size of the pet door 100 than that illustrated in figures.

The pet door 100 has an opening 140 in a lower portion 142 of the first panel 102. The opening 140 is illustrated as being comprised of four slits 144,146,148,150 in the lower portion 142. The opening 140 may be made of any number of appropriate slits and still fall within the scope of the present invention. The first slit 144 is vertical in orientation and intersects the second slit 146, which is horizontal in orientation, and the first slit 144 preferably intersects the second slit 146 at about the midpoint thereof. At either end of the second slit 146 are two vertically oriented slits 148,150, which complete the opening 140. Each of the slits 144,146,148,150 penetrate through the first panel 102 so as to allow movement of the flaps 152,154 created by slits 144, 146, and 148 and 144, 146, and 150, respectively. The pet can enter and exit the house by pushing on the flaps 152,154. The flaps 152,154 may also each have a magnet 156,158 attached to the inner corners thereof, which are attracted to one another, thereby keeping the flaps 152,154 together and the opening 140 closed. This keeps the cool air inside and the warm air and insects outside. It should be noted that the slits 144,146,148,150 are far enough away from the edges of the pet door 100 so as not to affect the integrity of the pet door 100, but close enough to allow even smaller pets to be able to use the door.

The pet door 100 may also have stitching 160 that provides a natural folding point for the pet door 100, for when the door 114 is in the closed position. See FIG. 3. The stitching 160 is known to be supportive and prevent the pliable material from breaking, cracking, or otherwise becoming brittle and deteriorating. As illustrated in FIG. 3, when the door 114 is closed, the pet door 100 can remain attached to the door frame 112 and to the door 114. The door 114 can be opened without having to attach the pet door 100 since it remains attached even when closed. As illustrated in FIG. 4, the pet door 100 may also have an extension 170 that is disposed at the top and/or bottom there of. The extension is preferably a resilient foam strip that engages the top and/or bottom of the door frame, thereby providing an additional way to seal the door opening when the door 114 is open. As the pet door 100 is stretched with the door 114 open, the extension 170 can resiliently engage the top and/or bottom of the door frame, much in the same way as weather stripping does. Naturally, the extension 170 is oriented on the appropriate side 116,118 of the pet door.

Figure 5:
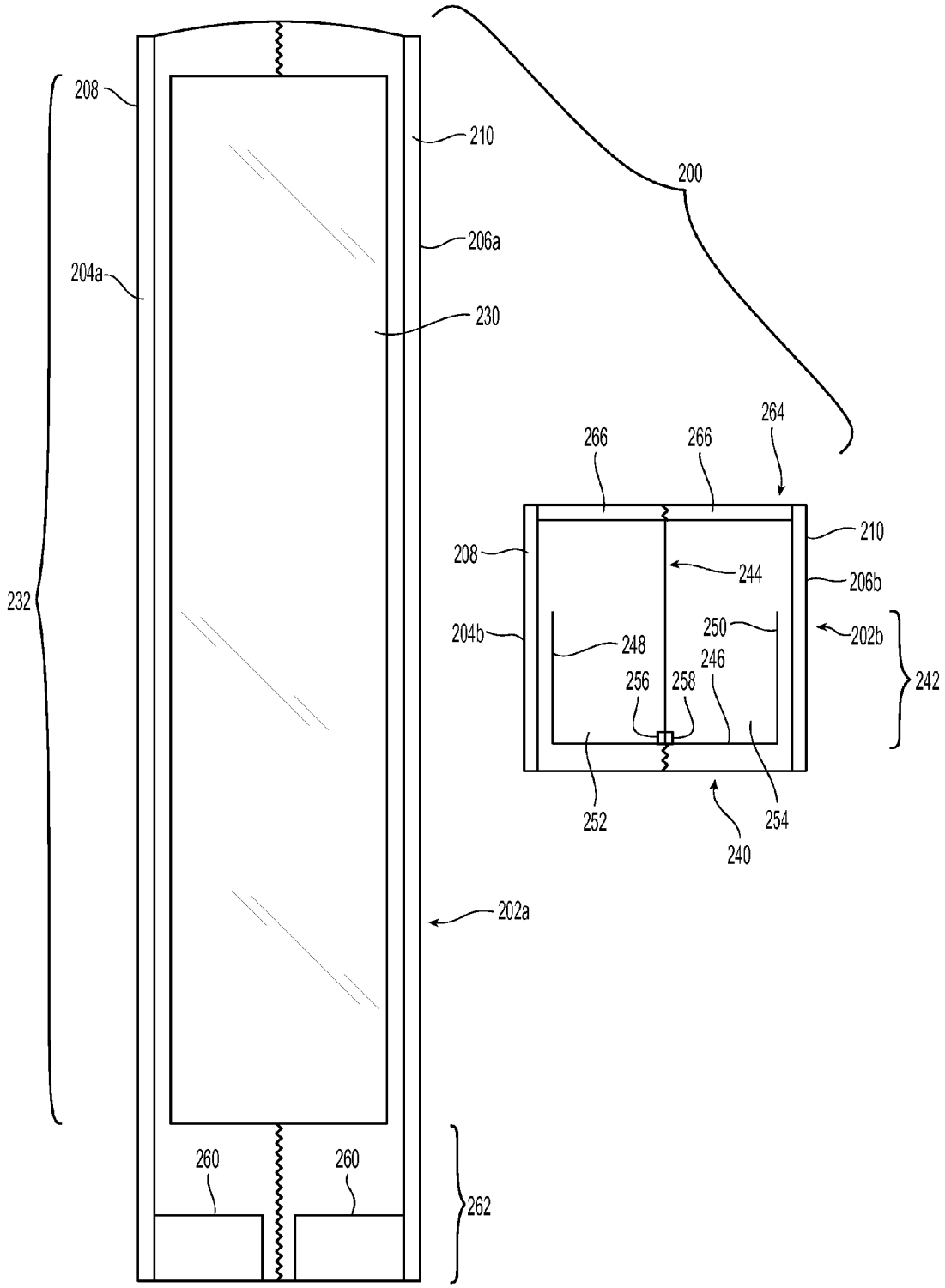
FIG. 5 is another embodiment of a pet door according to the present invention.

Another embodiment of a pet door 200 is illustrated in FIG. 5. The pet door 200 is similar to the first embodiment, but the first panel 202 of pet door 200 has two independent panels 202*a* and 202*b*. The features of the two panels 202*a* and 202*b* are the same as the first embodiment, but the two panel pet door 200 allows the owner/user to modify the height of the pet door 200 to accommodate different sizes of doors and openings. The panels 202*a* and 202*b* have a first edge portion 204*a* and 204*b*, respectively, and a second edge portion 206*a* and 206*b*, respectively. Each of the edge portions 204*a*, 204*b*, 206*a*, 206*b* have an attachment member 208,210, respectively, attached thereto. The attachment members 208,210 are preferably one portion of a hook-and-loop fastener. For example, the attachment members 208,210 could each be the hook portion of the hook-and-loop fastener, the loop portion of the hook-and-loop fastener, or even one could be the hook portion, while the other is the loop portion. The corresponding portion of the hook-and-loop fastener is then attached to a door frame 112 and a door 114. While the attachment members attached to the panels 202*a* and 202*b* are separate from one another (i.e., pieces of the hook-and-loop fasteners), the attachment members attached to the door frame 112 and the door 114 may be one continuous piece.

The pet door 200 is also preferably made from a pliable material such as PVC, plastic, or other materials suitable for the intended purpose. The pet door 200 may also have rigid portions as described in more detail below. The pet door 200 may have a clear portion 230 in a central portion 232 of the panel 202*a* to allow the owner to see through the pet door 200. The clear portion 230 may be transparent plastic (hard or soft/flexible) or, given the appropriate dimensions to allow for movement of the pet door 200 when the door 114 is moved, glass or glass based materials. The clear portion 230 may also be larger or smaller relative to the size of the pet door 200 than that illustrated in figures.

The bottom panel 202*b* has an opening 240 in a lower portion 242 of the panel 202*b*. The opening 240 is illustrated as being comprised of four slits in the lower portion 242. The first slit 244 is vertical in orientation and intersects the second slit 246, which is horizontal in orientation and the first slit 244 preferably intersects the second slit 246 at about the midpoint thereof. At either end of the second slit 246 are two vertically oriented slits 248,250, which complete the opening 240. Each of the slits 244,246,248,250 penetrate through the panel 202*b* so as to allow movement of the flaps 252,254 created by slits 244, 246, and 248 and 244, 246, and 250, respectively. The pet can enter and exit the house by pushing on the flaps 252,254.

The flaps 252,254 may also each have a magnet 256,258 attached to the inner corners thereof, which are attracted to one another, thereby keeping the flaps 252,254 together and the opening 240 closed. This keeps the cool air in and the warm air and insects out of the house. It should be noted that the slits 244,246,248,250 are far enough away from the edges of the pet door 200 so as not to affect the integrity of the pet door 200, but close enough to allow even smaller pets to be able to use the door.

The pet door 200 also has similar attachments members at the bottom of the panel 202*a* and the top of panel 202*b*. For example, the panel 202*a* has two larger attachment members 260 at the bottom 262. These may be one of the hook-and-loop fasteners while the top 264 of panel 202*b* has attachment members 266 which would the other of the hook-and-loop fasteners. The attachment members 260 and 266 cooperate to attach panels 202*a* and 202*b* to one another. Given the sizes of attachment members 260 and 266, the overall height of the pet door 200 can be altered to accommodate any variability in the height of the door 114 or door frame 112. Alternatively, the pet door 100, 200 could also be made of more sections of panels that allow for further adjustment of the overall height of the pet door.

Figure 6:
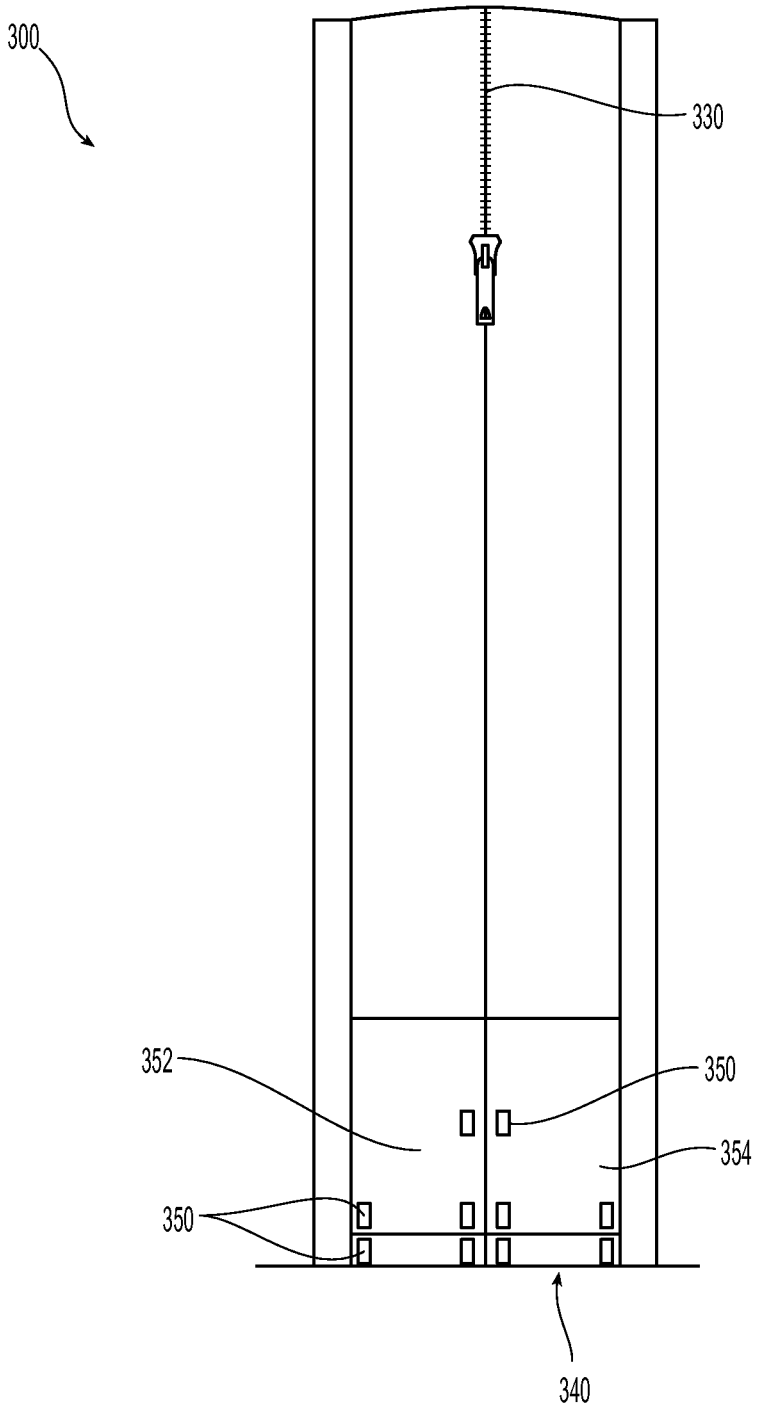
FIG. 6 is a front view of another embodiment of a pet door according to the present invention.

Another embodiment of a pet door 300 is illustrated in FIG. 6. The pet door 300 is similar to the other pet doors, but does not have a clear portion in the center of the pet door 300. Rather, the pet door 300 has a re-closable opening 330. The re-closable opening 330 is illustrated as being a zipper-type closure, but could also be a hook-and-loop fastener, snaps, etc. The opening 340 and flaps 352,354 also have more magnets 350 to keep the flaps closed on pet door 300.

Figure 7:
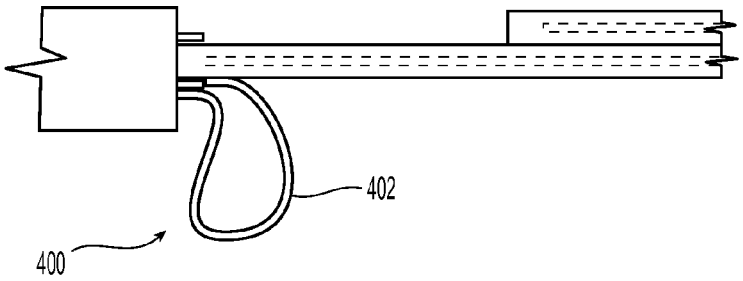
FIG. 7 is a top view of another embodiment of a pet door according to the present invention with the door in a closed position.

FIG. 7 is a top view of another embodiment of the pet door 400. In this embodiment, the panel 402 is completely pliable and does not have a preferred bending location. The pet door 400 is illustrated with the door in the closed position. Otherwise, the pet door 400 may have some or all of the other features of the pet doors noted above.

Figure 8:
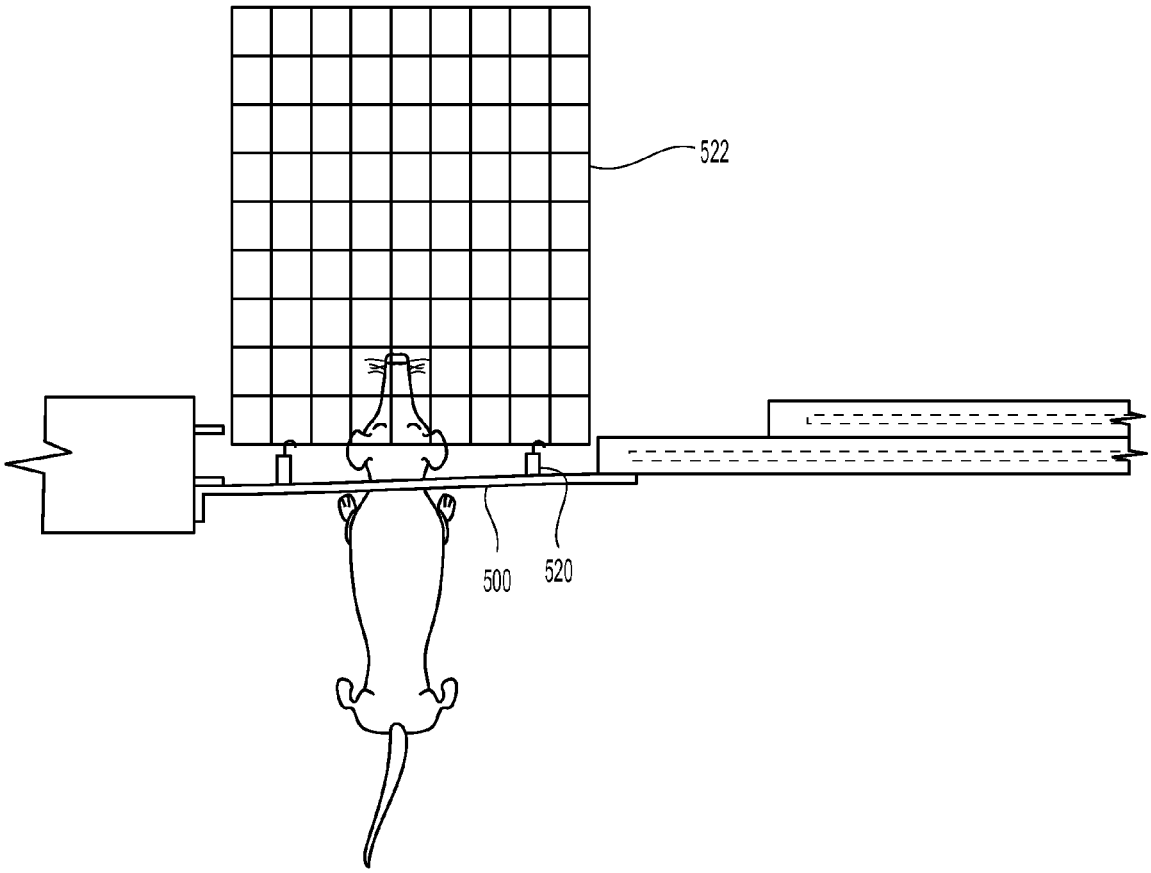
FIG. 8 is a top view of a pet door with hooking members attached thereto.

Another embodiment of a pet door 500 is illustrated in FIG. 8. Pet door 500 can be any of the pet doors discussed and described above. Pet door 500 has hooking members 520 that are attached to the pet door 500 at an appropriate height and to a pet container 522. The pet can enter the house through the pet door 500 but, given the proximity of the pet container 522 to the pet door 500, must enter into the pet container 522. In this way, the owner can prevent the pet from entering areas of the house where the pet is not allowed. The length of the hooking members 522 may depend on the type of pet container 522 and the type and size of the pet. The pet container 522 may also have a second door opposite the pet door 500 to allow for access to the house, if desired, and access to the pet by the owner without having to unhook the pet container from the pet door 500.

Figure 9:
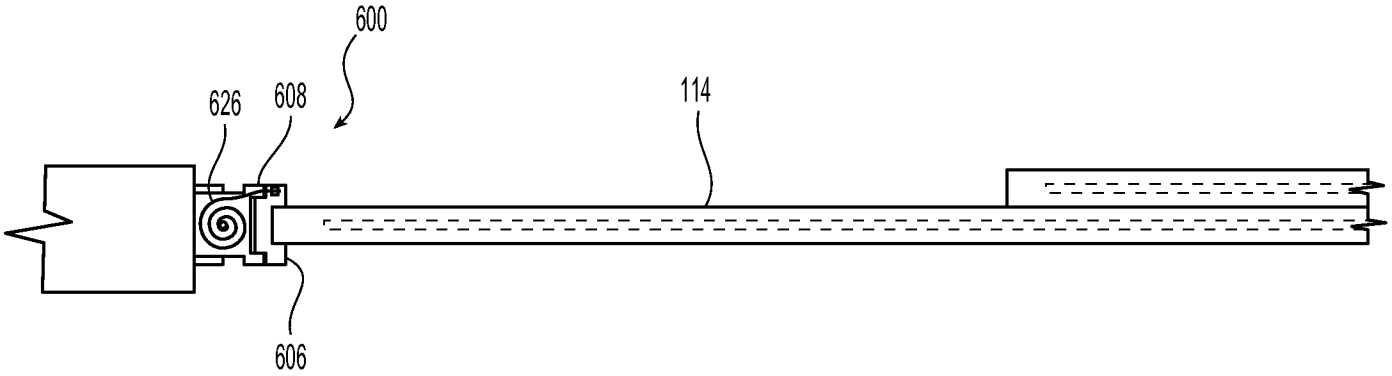
FIG. 9 is a top view of another embodiment of a pet door according to the present invention with the door in a closed position.
Figure 10:
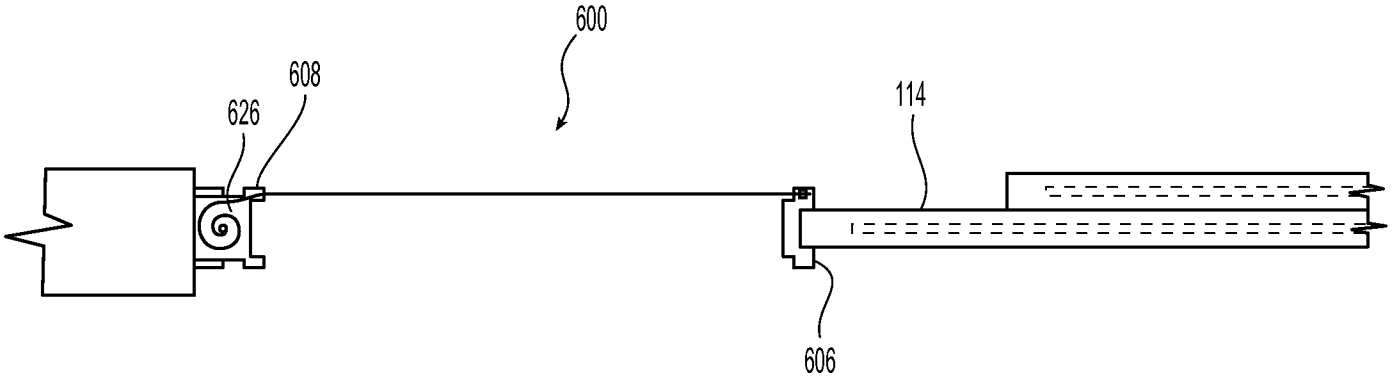
FIG. 10 is a top view of the pet door in FIG. 9 with the door in an open position.

Another embodiment of a pet door 600 is illustrated in FIGS. 9 and 10. The pet door 600 is preferably all pliable, with or without the clear panel. The pet door 600 has attachment members 606 and 608. Attachment member 606 is attached to one edge of the pet door 600 and is attached to the door 114. The attachment member 606 may be one portion of the hook-and-loop fastener or may be an elongated member that attaches directly to the door 114. The attachment member 608 is attached to the other side of the pet door 600 and also to the door frame 112. The attachment member 608 has a rotatable portion 626 that, when the door 114 is being closed, winds up the pet door 600. Similarly, when the door 114 is being opened, the rotatable portion 626 allows the pet door to unwind to a predetermined length. The attachment member 608 has features that allow the door 114, when in the closed position, to be sealed tightly against the attachment member 608, as if it were closed against the door frame.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

I claim:

1. A pet door to be used with a sliding glass door comprising:

a panel, the panel being flexible; and having a first edge portion and a second edge portion, the first edge portion opposite from the second edge portion;

a first attachment member attached to the first edge portion and a second attachment member attached to the second edge portion, the first attachment member connectable to one of an inside portion or an outside portion of the sliding glass door and the second attachment member connectable to one of an inside portion or an outside portion of a door frame associated with the sliding glass door;

an opening in a bottom portion of the panel, the opening sized to allow a pet to pass therethrough, the opening comprising a first slit penetrating the panel and a second slit penetrating the panel, the first slit and second slit intersecting one another and disposed inwardly from edges of the panel; and the panel attachable to the sliding glass door and the door frame in both a first position and a second position, in the first position the sliding door is open and in the second position the sliding door is closed, wherein the panel has stitching along at least a portion of a panel length, thereby providing a folding line for the pet door, wherein the stitching extends vertically above the first and second slits.

2. The pet door according to claim 1, wherein the panel has a central portion, the central portion being comprised of a clear plastic material to allow a user to see through the panel, the clear material extending across the panel.

3. The pet door according to claim 1, wherein the panel is a pliable material.

4. The pet door according to claim 1, wherein the panel comprises at least two panels, wherein the at least two panels include an upper panel and a lower panel, the upper panel having a see-through portion and the lower panel having the opening for the pet.

5. The pet door according to claim 4, wherein the upper panel and the lower panel may be positioned relative to one another to adjust an overall height of the pet door.

6. The pet door according to claim 1, the first and second slits forming at least two corners in the panel, the panel having magnetic elements disposed therein to attract the at least two corners to one another.

7. The pet door according to claim 1, wherein the panel has an extension disposed on each of a top edge and a bottom edge of the panel to engage a portion of the door frame of the sliding glass door when in the first position.

8. The pet door according to claim 7, wherein the extension is a resilient foam strip.

9. The pet door according to claim 1, wherein the second attachment member attached to the first edge portion includes a rotatable portion to wind up the panel during the closing of sliding glass door.

10. The pet door according to claim 1, wherein the panel is folded along the folding line when the sliding glass door is in the second position.

11. The pet door according to claim 1, further comprising hooking members and a pet container, the hooking members attached to the panel and extending outwardly from the pet door and into a dwelling to which the sliding glass door is connected to engage the pet container and maintain the pet container in a fixed relation to the pet door.

12. A pet door to be used with a sliding glass door comprising:

a panel, the panel being flexible and having a first edge portion and a second edge portion, the first edge portion opposite from the second edge portion;

a first attachment member attached to the first edge portion and a second attachment member attached to the second edge portion, the first attachment member connectable to one of an inside portion or an outside portion of the sliding glass door and the second attachment member connectable to one of an inside portion or an outside portion of a door frame associated with the sliding glass door;

an opening in a bottom portion of the panel, the opening sized to allow a pet to pass therethrough, the opening comprising a first slit penetrating the panel and a second slit penetrating the panel, the first slit and second slit intersecting one another and disposed inwardly from edges of the panel; and an extension disposed on each of a top edge and a bottom edge of the panel to engage a portion of the door frame of the sliding glass door when in a first position, the panel attachable to the sliding glass door and the door frame in both the first and a second position, in the first position the sliding door is open and in the second position the sliding door is closed, wherein the panel has stitching along at least a portion of a panel length, thereby providing a folding line for the pet door, wherein the stitching extends vertically above the first and second slits.

13. The pet door according to claim 12, wherein the panel has a central portion, the central portion being comprised of a clear plastic material to allow a user to see through the panel.

14. The pet door according to claim 12, wherein the panel is a pliable material.

15. The pet door according to claim 12, wherein the panel comprises at least two panels, wherein the at least two panels include an upper panel and a lower panel, the upper panel having a see-through portion and the lower panel having the opening for the pet.

16. The pet door according to claim 12, wherein the opening is comprised of at least two intersecting slits, the intersecting slits forming the two corners in the panel, the panel having magnetic elements disposed therein to attract the at least two corners to one another.

17. A pet door to be used with a sliding glass door comprising:

a panel, the panel being flexible; and having a first edge portion and a second edge portion, the first edge portion opposite from the second edge portion;

an attachment member attached to each of the first edge portion and the second edge portion, the attachment member connectable to one of the sliding glass door and a door frame associated with the sliding glass door, and the attachment member attached to the first edge portion includes a rotatable portion to wind up the panel during closing of the sliding glass door;

an opening in a bottom portion of the panel, the opening sized to allow a pet to pass therethrough, the opening comprising a first slit penetrating the panel and a second slit penetrating the panel, the first slit and second slit intersecting one another and disposed inwardly from edges of the panel; and the panel being attached to the sliding glass door and the door frame in both a first position and a second position, in the first position the sliding door is open and in the second position the sliding door is closed and the first edge portion and the second edge portion are closer to one another in the second position than in the first position, wherein the panel has stitching along at least a portion of a panel length, thereby providing a folding line for the pet door, wherein the stitching extends vertically above the first and second slits.

* * * * *